US006749288B2

(12) United States Patent
Ahne et al.

(10) Patent No.: US 6,749,288 B2
(45) Date of Patent: Jun. 15, 2004

(54) JET HEAD BOX

(75) Inventors: Adam Jude Ahne, Lexington, KY (US); Frank Edward Anderson, Sadieville, KY (US); Patrick Laurence Kroger, Versailles, KY (US); Randall David Mayo, Georgetown, KY (US); Sean Terrance Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/284,065

(22) Filed: Oct. 30, 2002

(65) Prior Publication Data

US 2004/0085387 A1 May 6, 2004

(51) Int. Cl.[7] ..... B41J 2/05
(52) U.S. Cl. ..... 347/56; 347/63; 347/65
(58) Field of Search ..... 347/71, 59, 58, 347/109, 56, 63, 65, 45, 47, 44, 87

(56) References Cited

U.S. PATENT DOCUMENTS 5,835,110 A * 11/1998 Sasaki ..... 347/40
5,874,971 A * 2/1999 Nishioka et al. ..... 347/20
6,000,787 A 12/1999 Weber et al.
6,227,651 B1 5/2001 Watts et al.
6,243,109 B1 6/2001 Ishinaga et al.
2001/0004263 A1 6/2001 Ishinaga et al.
2001/0040594 A1 11/2001 Sleger et al.

* cited by examiner

*Primary Examiner*—Stephen D. Meier
*Assistant Examiner*—Charles Stewart
(74) *Attorney, Agent, or Firm*—Luedeka, Neely & Graham, P.C.

(57) ABSTRACT

A jet head box for a semiconductor substrate and nozzle plate containing fluid jet actuators. The jet head box includes an elongate substantially rigid body having a first surface and a second surface opposite the first surface. The body also includes a first recessed portion defining a substrate pocket area in the first surface thereof. An elongate slot extends through the body from the second surface to the first surface in the substrate pocket area. An encapsulant dam is provided adjacent at least one end thereof. A shelf is adjacent the encapsulant dam. The jet head box provides a low cost construction for simple miniature fluid jetting devices.

21 Claims, 4 Drawing Sheets

JET HEAD BOX

FIELD OF THE INVENTION

The invention relates to micro-miniature jet nozzle fabrication components and in particular to semiconductor construction and mounting techniques for miniature jetting devices.

BACKGROUND OF THE INVENTION

Micro-miniature jetting devices are suitable for a variety of applications including hand-held ink jet printers, ink jet highlighters, ink jet air brushes, and delivery of controlled quantities of medicinal fluids and purified water to precise locations. One of the challenges to providing such micro-miniature jetting devices on a large scale is to provide a manufacturing process that enables high yields of high quality jetting devices. While ink jet manufacturing techniques are well known, they do not lend themselves to low cost production techniques because of the exacting nature of the product used for ink jet printers. There is a need therefore, for micro-miniature jetting devices which lend themselves to reduced manufacturing costs.

SUMMARY OF THE INVENTION

With regard to the foregoing and other objects and advantages the invention provides a jet head box for a semiconductor substrate and nozzle plate containing fluid jet actuators. The jet head box includes an elongate substantially rigid body having a first surface and a second surface opposite the first surface. The body also includes a first recessed portion defining a substrate pocket area in the first surface thereof. At lease one elongate slot extends through the body from the second surface to the first surface in the substrate pocket area. An encapsulant dam is provided adjacent at least one end thereof. A shelf is adjacent the encapsulant dam.

In another embodiment the invention provides a micro-miniature fluid jetting device. The device includes a jet head box having an elongate substantially rigid body. The body has a first surface and a second surface opposite the first surface. A first recessed portion defining a substrate pocket area is provided in the first surface thereof. At least one elongate slot extends through the body from the second surface to the first surface in the substrate pocket area. The body further includes an encapsulant dam adjacent at least one end thereof, and a shelf adjacent the encapsulant dam. A semiconductor substrate and nozzle plate therefor is attached to the first surface of the jet head box in the first recessed portion. Conductive leads are attached to the semiconductor substrate. Contact pads are provided on the conductive leads and semiconductor substrate. An encapsulant for encapsulating the contact pads on the conductive leads and semiconductor substrate is also provided.

In yet another embodiment, the invention provides a method for encapsulating connections between conductive leads and a semiconductor substrate for a micro-miniature fluid jetting device. The method includes the steps of providing a jet head box including an elongate substantially rigid body, the body having a first surface and a second surface opposite the first surface, a first recessed portion defining a substrate pocket area in the first surface thereof, at least one elongate slot extending through the body from the second surface to the first surface in the substrate pocket area, a first jet head box end and an opposing second jet head box end, the body further including an encapsulant dam adjacent at least the first jet head box end, a shelf adjacent the encapsulant dam, and at least one conductive lead adjacent the encapsulant dam and extending onto the shelf. A semiconductor substrate and nozzle plate therefor is attached to the first surface of the jet head box in the first recessed portion thereof. A first end of the semiconductor substrate is connected to the at least one conductive lead. The jet head box is tilted to an angle ranging from about 5 to about 45 degrees relative to a substantially horizontal plane so that the first jet head box end is lower than the second jet head box end. A substantially low viscosity encapsulant material is applied to the conductive lead and first end of the semiconductor substrate. Upon curing, a cured encapsulant material is provided. The cured encapsulant material has a sloped surface extending from the encapsulant dam to the first end of the semiconductor substrate.

An advantage of the invention is that it provides a structure which significantly minimizes the manufacturing costs for micro-miniature fluid jetting devices. For simple fluid jetting applications, substantially all logic and timing circuits are preferably contained on the semiconductor substrate so that only power and ground leads are required to be connected to the substrate. In the alternative, up to about ten leads are attached to the semiconductor substrate for control of fluid jetting. Hence, once the substrate, head box and leads are assembled, the entire assembly may be handled in an environment other than a clean room.

Applications for such micro-miniature jetting devices include, but are not limited to pre-coat applicators for ink jet printers, sterile water spray devices for surgery, lubricating oil spray devices for mechanical equipment, spray cleaners for recording devices, small local fire extinguishers, evaporative coolers, and the like.

Another advantage of the invention is that cleaning of the jetting nozzles is un-hindered by sealants and encapsulants used to protect electrical connections to the micro-miniature jetting device. This advantage is achieved by providing electrical connections to the semiconductor substrate that are on an end of the substrate perpendicular to the jetting nozzles and direction of travel of a cleaning device or wiper blade across the jetting nozzles.

BRIEF DESCRIPTION OF THE DRAWINGS

Further advantages of the invention will become apparent by reference to the detailed description of preferred embodiments when considered in conjunction with the drawings, wherein like reference characters designate like or similar elements throughout the several drawings as follows.

DETAILED DESCRIPTION OF THE INVENTION

Figure 1:
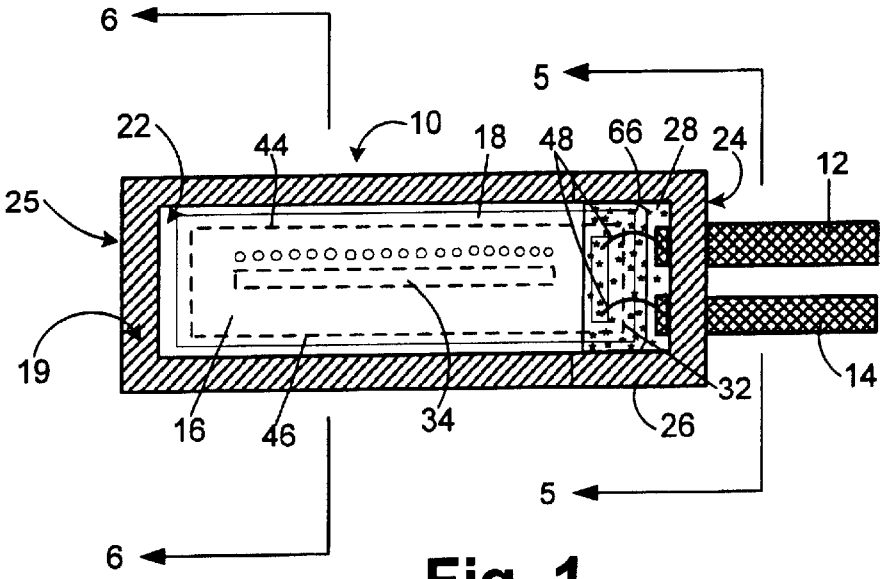
FIG. 1 is a top plan view, not to scale, of a jet head box containing a semiconductor substrate, nozzle plate, and contact leads according to a first embodiment of the invention.
Figure 8:
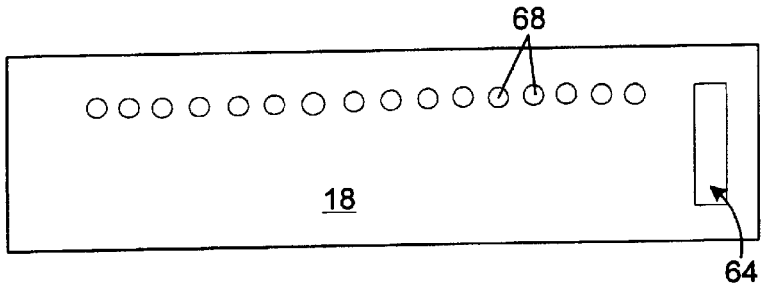
FIG. 8 is a plan view, not to scale, of a nozzle plate for jetting a fluid using a jet head box according to the invention.

With reference to FIGS. 1–5, various aspects of the invention are illustrated. FIG. 1 is a top plan view of a jet head box 10 containing conductive leads 12 and 14, a semiconductor substrate 16, and a nozzle plate 18. The nozzle plate 18, described in more detail below with reference to FIG. 8, is typically attached to the substrate 16 prior to attaching the substrate 16 to the jet head box 10. The jet head box 10 has a first surface 19 and a second surface 20 (FIG. 3) opposite the first surface 19. A first recessed area is provided in the first surface of the jet head box defining a substrate pocket area 22. A first end 24 of the jet head box 10 has a raised portion providing an encapsulant dam 26. A shelf 28 is preferably provided adjacent the encapsulant dam 26 for supporting one end of the conductive leads 12 and 14. At least one elongate fluid slot 30 is preferably formed in the jet head box 10 extending from the second surface 20 to the first surface 19 thereof. For multi-color ink jet printing applications, the jet head box 10 may contain two, three, or four elongate fluid slots such as slot 30 for ejecting two, three, or four colors of ink toward a print media using one to four substrates and nozzle plates. Cross-sectional views 5 and 6 (FIG. 1) are provided in FIGS. 5 and 6 respectively for a jet head box 10 containing a single elongate slot 30.

The jet head box 10 may be fabricated from a wide variety of non-conductive materials, including, but not limited to, ceramics, plastics, wood, plastic coated metal, and the like. A preferred material for the jet head box 10 is a standard material for a surface mounted integrated circuit (IC) package such as a high softening point thermoplastic material. The jet head box 10 may be molded or machined to provide the features thereof such as the substrate pocket area 22, elongate fluid slot 30, shelf 28, and encapsulant dam 26. For a jet head box 10 molded from a thermoplastic or thermoset polymeric material, it is preferred to provide insert molded conductive leads 12 and 14 for attachment to the semiconductor substrate 16.

In keeping with the desire to provide a low cost micro-miniature fluid jetting device, the overall size of the jet head box 10 is relatively small. Preferably, the overall dimensions of the jet head box 10 are from about 6 to about 12 millimeters in length, from about 3 to about 7 millimeters in width, and from about 2 to about 4 millimeters in thickness. The semiconductor chip 16 attached to the jet head box 10 preferably has a length ranging from about 3 to about 8 millimeters in length, from about 0.9 to about 2.9 millimeters in width, and from about 0.5 to about 1.0 millimeters in thickness. A nozzle plate 18 having similar dimensions to that of the semiconductor substrate 16 is attached to the substrate 16. Accordingly, the depth of the substrate pocket area 22 preferably ranges from about 1.0 to about 2.0 millimeters in depth. The dimensions of the fluid slot 30 in the jet head box 10 are not critical to the invention provided the fluid slot 30 provides a sufficient opening for flow of fluid to the semiconductor substrate. Preferred dimensions of the fluid slot 30 range from about 4.5 to about 5.5 millimeters in length and from about 1.0 to about 1.5 millimeters in width.

As shown in FIG. 1, at least two conductive leads 12 and 14 are provided. However, from about 2 to about 10 conductive leads may be provided depending on the use of the micro-miniature fluid jetting device. Regardless of the number of leads provided, it is preferred that all of the connections to the semiconductor substrate be provided on an. end, such as first end 32, of the semiconductor substrate 16 perpendicular to a length dimension of an elongate fluid via 34 in the substrate 16. In the first embodiment, conductive leads 12 and 14 are insert-molded providing insert-molded slots 35 (FIGS. 4 and 5) in the first end 24 of the jet head box 10 for connection to the first end 32 of the semiconductor substrate 16.

Figure 2:
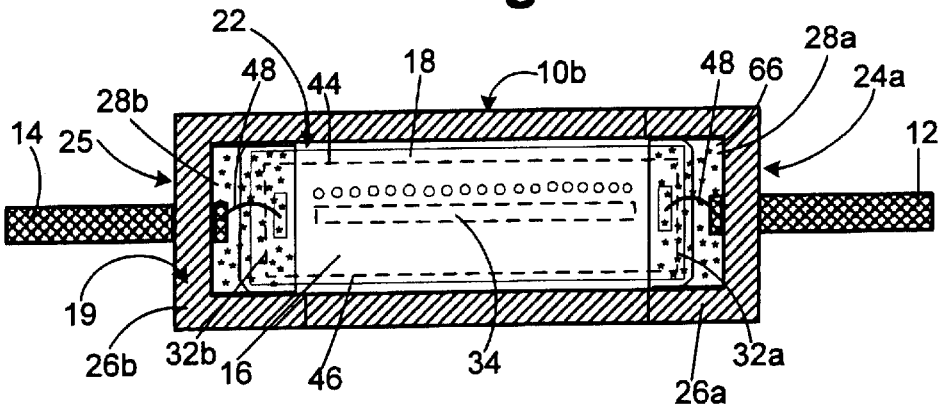
FIG. 2 is a top plan view, not to scale, of a jet head box containing a semiconductor substrate, nozzle plate, and contact leads according to a second embodiment of the invention.
Figure 3:
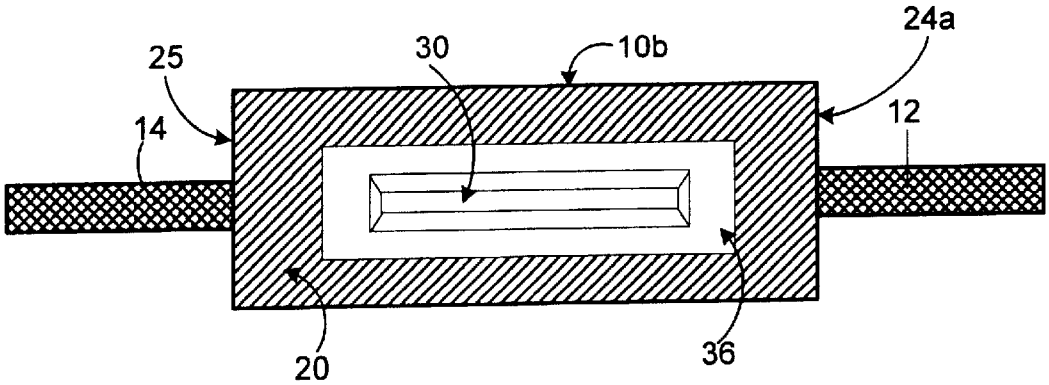
FIG. 3 is a bottom plan view, not to scale, of a jet head box containing contact leads according to the second embodiment of the invention.

In a second embodiment illustrated in FIGS. 2 and 3, conductive leads 12 and 14 are insert molded on opposing ends 24*a* and 25 of the jet head box 10*b*. Accordingly, the conductive leads 12 and 14 are attached to opposing ends 32*a* and 32*b* of the semiconductor substrate 16. For this embodiment, the jet head box 10*b* preferably contains two encapsulant dams, 26*a* and 26*b*. The purpose of the encapsulant dam(s) 26 is discussed below.

The second surface 20 of the jet head box 10*b* (FIG. 3) may contain a second recessed portion defining a filter pocket area 36. It is preferred that a filter 38 (FIG. 6) be attached in the filter pocket area 36 on the second surface of the jet head box 10*b* before the jet head box 10 leaves a clean room area where the semiconductor substrate 16 is attached to the jet head box 10. In an alternative design, a filter may be attached to the semiconductor substrate 16 between the substrate 16 and the first surface 19 of the jet head box 10, or a filter may be integrated into the nozzle plate 18 between the substrate 16 and nozzle plate 18. A nozzle plate 18 containing an integrated filter is described, for example, in U.S. Pat. No. 6,045,214 to Murthy et al. entitled "Ink jet printer nozzle plate having improved flow feature design and method of making nozzle plates," the disclosure of which is incorporated by reference as if fully set forth herein.

Figure 6:
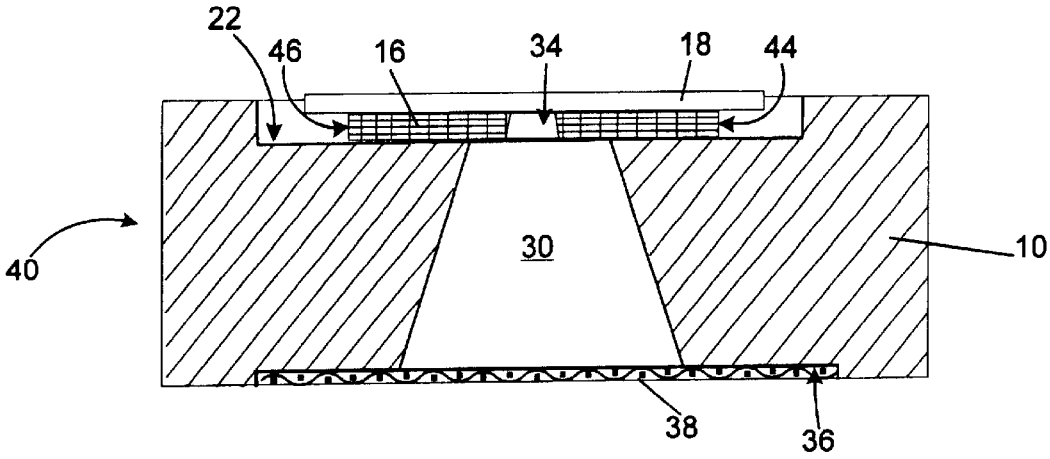
FIG. 6 is a cross-sectional view not to scale through a jet head box according to the invention.

FIG. 6 is a cross-sectional view, not to scale of an assembled micro-miniature jetting device 40 containing the filter 38, semiconductor substrate 16 and nozzle plate 18 viewed toward an end 25 opposite end 24 thereof. As seen in the cross-sectional view, no electrical connections are made to the semiconductor substrate 16 along elongate sides 44 and 46 of the substrate 16. Because there are no electrical connections along the elongate sides 44 and 46 of the substrate 16, cleaning of the nozzle plate 18 is significantly enhanced. If connections were made on the elongate sides 44 and 46, raised areas caused by encapsulating materials may interfere with efficient cleaning of the nozzle plate 18 as a wiper blade or other cleaning device traverses the nozzle plate 18 from side 44 to side 46 or vice versa. However, having electrical connections only on adjacent ends, such as end 24, of the jet head box 10 reduces the interference of encapsulating materials with the nozzle plate 18 cleaning process.

Figure 4:
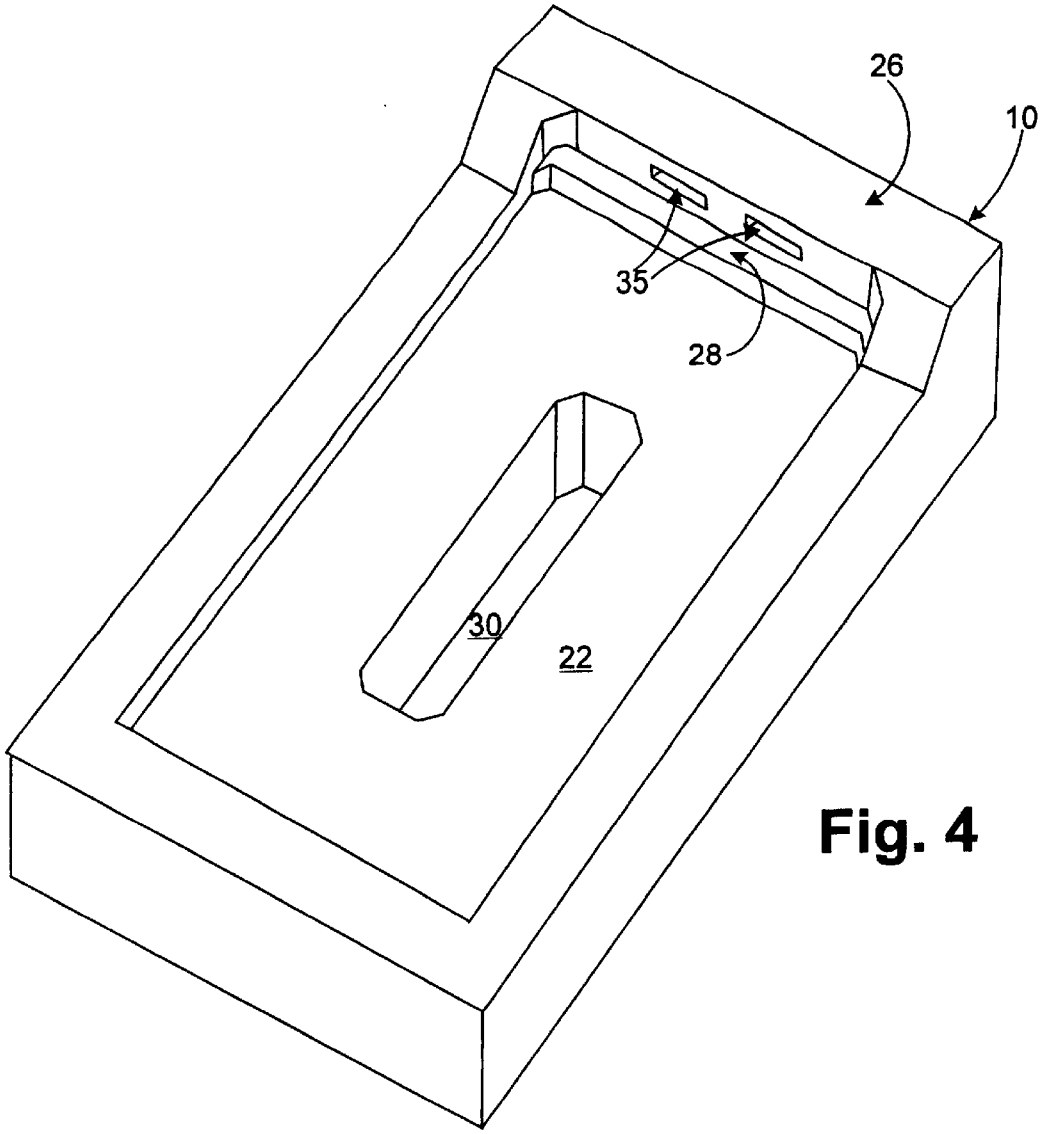
FIG. 4 is a perspective view of a jet head box according to the invention.
Figure 5:
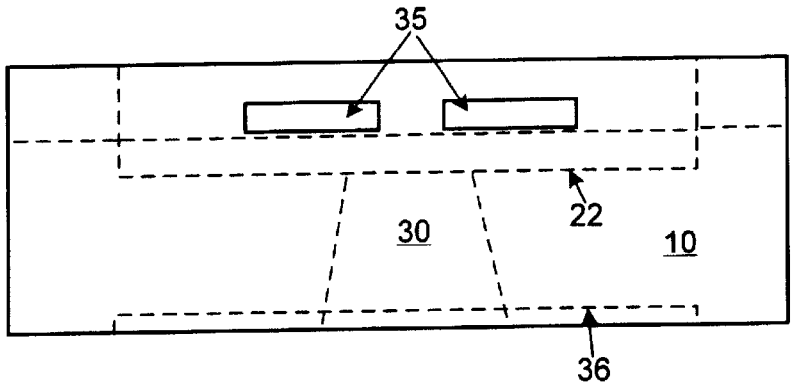
FIG. 5 is an end view of a jet head box according to the first embodiment of the invention.
Figure 9:
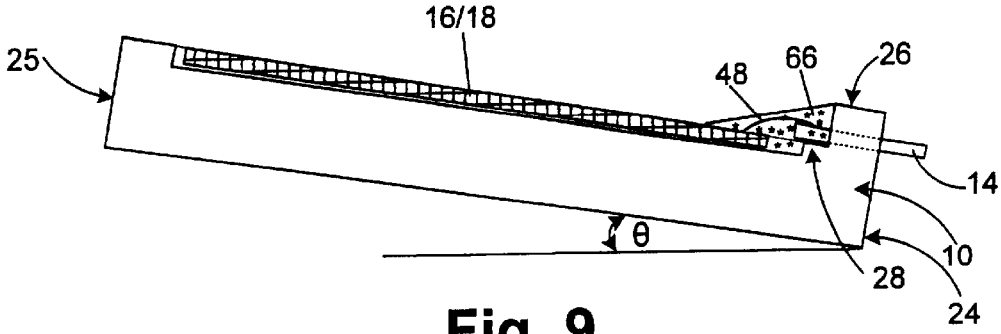
FIGS. 9 and 10 illustrate a method for providing a triangular shaped epoxy seal for lead connections to the jet head box.
Figure 10:
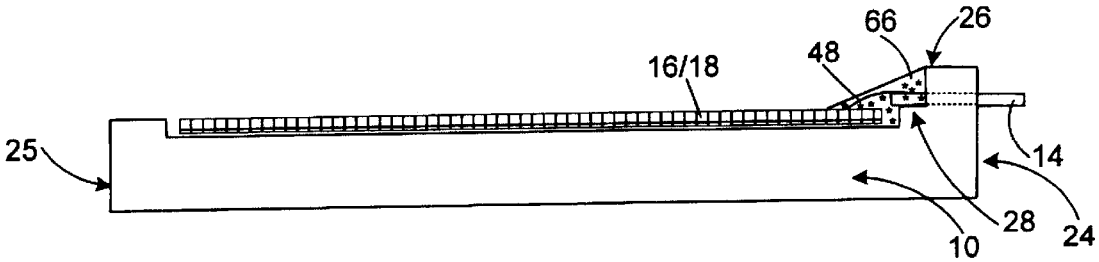

With reference to FIGS. 4 and 9–10, an important feature of the invention will now be described. As set forth above, the preferred jet head box 10 of the invention includes at least one encapsulant dam 26 and shelf 28. The shelf 28 provides support for the conductive leads such as lead 14. After attaching a semiconductor substrate/nozzle plate 16/18 in the substrate pocket 22, the conductive leads 12 and 14 are electrically connected to the substrate 16 as by wire bonding or tape automated bonding (TAB) circuit 48.

Figure 7:
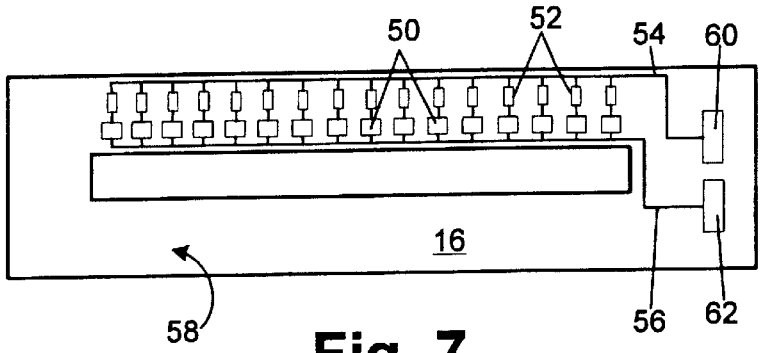
FIG. 7 is a plan view, not to scale, of a semiconductor substrate for attachment to a jet head box according to the invention.

A typical semiconductor substrate 16 (FIG. 7) contains a plurality of fluid ejection devices 50 and driver circuitry 52 connected to the devices 50. The fluid ejection devices 50 may be heater resistors or piezoelectric devices. Resistive heating devices are illustrated in FIG. 7. Conductive traces 54 and 56 provided on surface 58 of semiconductor substrate 16 connect the fluid ejection devices 50 and driver circuitry 52 to contact pads 60 and 62 on the surface 58 of the substrate 16. The contact pads 60 and 62 provide areas for electrical connection to the conductive leads 12 and 14 as by wire bonding or TAB bonding circuit 48. Since the nozzle plate 18 is preferably attached to the semiconductor substrate 16 prior to connecting the contact pads 60 and 62 to the conductive leads 12 and 14, a window or opening 64 is preferably provided in the nozzle plate 18 for making the electrical connection between the contact pads 60 and 62 and the conductive leads 12 and 14.

In order to protect the connections between the contact pads 60 and 62 and conductive leads 12 and 14 from corrosion caused by the fluid ejected by the ejection device 40, an encapsulant 66 is preferably applied to the connections. The encapsulant 66 is preferably resistant to the fluids used in the micro-miniature ejecting device, such as ink, oil and the like, and preferably has a relatively low viscosity so that the encapsulant material 66 will flow and substantially completely encapsulate the end 32 of the substrate 16, contact pads 60 and 62, wire bonding or TAB bonding circuit 48, and conductive leads 12 and 14. The encapsulant material 66 should also readily flow through window 64 and wet the shelf 28, substrate pocket 22 and encapsulant dam 26 for good adhesion thereto. The encapsulant material 66 should also not wick toward the ejection devices 50 and nozzle holes 68 in the nozzle plate 18, otherwise interruption of fluid flow may occur once the encapsulant is cured. Nozzle holes 68 in the nozzle plate 18 are illustrated in FIG. 8.

An encapsulant with too high a viscosity will not adequately protect the connections from corrosion. If the viscosity of the encapsulant is too low, wicking or flow toward the nozzle holes 68 in the nozzle plate 18 may occur. However, as described below, the encapsulant dam 26 enables the use of an encapsulant with a relatively low viscosity while reducing or eliminating blockage of the nozzle holes 68 by the encapsulating material.

Preferred encapsulants 66 are snap cure epoxy adhesives that exhibit minimal viscosity and thixotropy loss throughout the cure period. Such epoxy materials preferably cure in about 10 to about 15 minutes or less. Curing of the encapsulant may be conducted with heat, ultraviolet (UV) radiation, or a combination thereof. Snap cure adhesives such as an adhesive available from Electronic Adhesives, Inc. of San Jose, Calif. under the trade name BONDLINE 6485 and an adhesive available from Epoxy Technology of Billerica, Massachusetts under the trade name EPO-TEK T6116 may be used. Particularly preferred encapsulants 66 include a snap cure adhesive available from Engineered Materials Systems, Inc. of Delaware, Ohio under part number 502-78 and a UV curable adhesive available from Emerson & Cuming of Bilerica, Mass. under the trade name ECCOBOND UV 9000. For the first embodiment described above with electrical connections only on end 24 of the jet head box 10, a non-conductive epoxy adhesive is preferred. In the embodiment shown in FIGS. 2 and 3, a conductive epoxy encapsulant may be used, in which case, wire bonding or TAB bonding circuit 48 may not be required.

Use of the encapsulant dam 26 for providing a cured encapsulant 66 having a sloped surface will now be described with reference to FIGS. 9 and 10. Prior to applying the encapsulating material 66 to the conductive leads 14 and 16 and the contact pad 62 through window 64, the entire jet head box is tilted so that end 24 is lower than end 25. The amount the jet head box 10 is tilted is dependant on the viscosity of the encapsulating material 66. Preferably, the jet head box is tilted at an angle θ that ranges from about 5 to about 70 degrees. A particularly preferred angle θ ranges from about 40 to about 50 degrees.

Once, the jet head box 10 is tilted to the desired angle θ, the encapsulating material 66 is applied to the connections. The encapsulating dam 26 retains the encapsulating material in the area of the connections during the applying and curing process. As seen in FIG. 9, because of the encapsulating dam 36 and tilted angle θ of the jet head box 10, the encapsulating material 66 takes on a sloped surface relative to the plane of the semiconductor/nozzle plate 16/18 assembly. Upon curing, a sloped encapsulating material 66 as shown in FIG. 9 is provided. Because the encapsulating material 66 slopes away from the nozzle holes 68, cleaning of the nozzle plate 18 is further enhanced. As seen in FIG. 1, the encapsulating material 66 is located remote from the center area of the jet head box 10.

Once the encapsulant material 66 is cured, the jet head box assembly 40 can be handled in an environment other than a clean room. Accordingly, the assembly 40 can be attached to a fluid reservoir in a non-clean room environment or the assembly 40 can be shipped to remote locations for assembly to a fluid reservoir. The assembly 40 is substantially robust and thus does not require any special handling or care.

Figure 11:
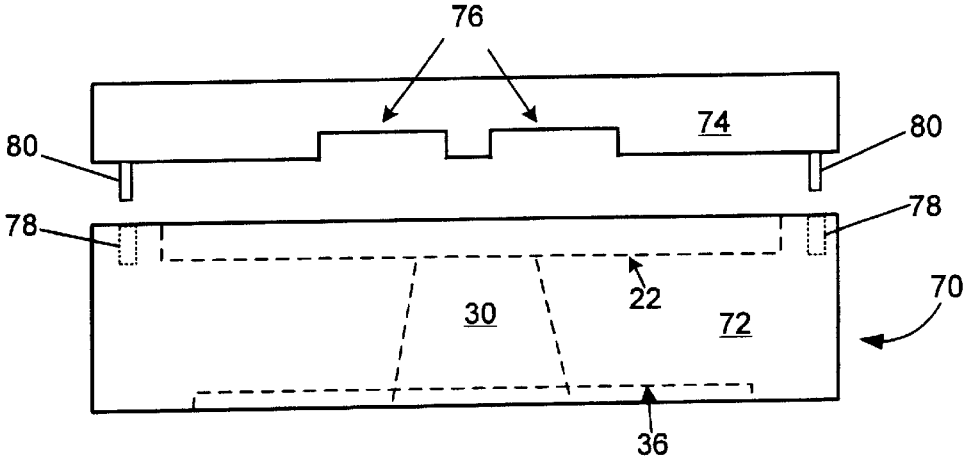
FIG. 11 is an end view of a jet head box according to a third embodiment of the invention.

In another embodiment, illustrated in FIG. 11, a TAB bonding circuit is used instead of wire bonding for connecting conductive leads to the semiconductor substrate 16. Since the conductive leads, such as leads 12 and 14 cannot be insert molded in the jet head box in this embodiment, the jet head box 70 is comprised of a body portion 72 and at least one encapsulant dam portion 74. The encapsulant dam portion 74 contains one or more cut outs, such as cut outs 76 for a TAB circuit as described above.

During assembly of a micro-fluid ejecting device using the jet head box 70, the TAB circuit is first attached to the substrate/nozzle plate assembly 16/18. The substrate/nozzle plate assembly 16/18 is then adhesively attached to the body portion 72 in the substrate pocket area 22. Next, the encapsulant dam portion 74 is attached to the body portion 72 as be adhesives, snaps such as sockets 78 and posts 80, or by both adhesives and snaps. The encapsulant dam portion 74 may be attached to one or both ends of the body portion 72 as described above. Finally, an encapsulant material 66 is applied to the connections between the TAB bonding circuit and the substrate 16 as generally described above.

Encapsulant dams and the application of encapsulant materials to fluid ejecting devices, as generally described above, may also be used for applying encapsulant materials to conventional ink jet printheads having flexible circuit or TAB circuit connections along the elongate side of the substrate rather than on the ends of the substrate perpendicular an elongate via in the substrate. Use of the encapsulant dams for conventional printhead construction may be effective to reduce or prevent encapsulant material from flowing into nozzle holes on a nozzle plate attached to a substrate while applying encapsulant materials to the connections between a flexible circuit or TAB circuit and the substrate. For example, encapsulant dams may be located on a printhead body to which the substrate is attached along both elongate sides of the substrate or around the perimeter of the substrate. A snap cure adhesive material, as described above, may be applied to one elongate edge of the substrate after attaching the substrate to the printhead body while tilting the printhead body in one direction as described above. Next, the printhead body is tilted in the opposite direction and the snap cure adhesive material is applied to the opposite elongate edge of the substrate.

For use of a jet head box 10, 10*b* or 70 in an ink jet application, for example, an ink reservoir is provided. The reservoir may be a plastic body filled with foam. The plastic body is attached to the jet head box assembly 40 as by a gasket or sealant and the reservoir is filled with ink. A lid or cover is then attached to the plastic body, the assembled unit is primed, the nozzle holes 68 are sealed as by a removable tape, and the assembled unit is packaged for shipping. Other uses of the jet head box assembly 40 of the invention include delivery of pre-coat materials to a print media in an ink jet printer, delivery of sterile water for flushing surgical incisions, delivery of lubricating materials intermittently to moving parts of mechanical equipment, and a wide variety of other uses requiring the delivery of small, controlled amounts of fluids.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A jet head box for a semiconductor substrate and nozzle plate containing fluid jet actuators, the jet head box comprising an elongate substantially rigid body having a first surface and a second surface opposite the first surface, the body including a first recessed portion defining a substrate pocket area in the first surface thereof, and at least one elongate slot extending through the body from the second surface to the first surface in the substrate pocket area, the body further including an encapsulant dam adjacent at least one end thereof, and a shelf defined adjacent the encapsulant dam.

2. The jet head box of claim 1 further comprising at least one insert-molded conductive lead adjacent the encapsulant dam and extending onto the shelf.

3. The jet head box of claim 1 comprising two encapsulant dams and a shelf adjacent each of the encapsulant dams.

4. The jet head box of claim 3 further comprising an insert-molded conductive lead adjacent each of the encapsulant dams and extending onto the shelves.

5. The jet head box of claim 1 further comprising a second recessed portion defining a filter media pocket in the second surface thereof.

6. The jet head box of claim 1 comprising a molded polymeric material.

7. The jet head box of claim 1 comprising a cast insulating material.

8. The jet head box of claim 1 comprising from two to four elongate slots extending through the body from the second surface to the first surface in the substrate pocket area thereof.

9. A micro-miniature fluid jetting device comprising the jet head box of claim 1.

10. A micro-miniature fluid jetting device comprising:

a jet head box including an elongate substantially rigid body, the body having a first surface and a second surface opposite the first surface, a first recessed portion defining a substrate pocket area in the first surface thereof, and at least one elongate slot extending through the body from the second surface to the first surface in the substrate pocket area, the body further including an encapsulant dam adjacent at least one end thereof, and a shelf adjacent the encapsulant dam;

a semiconductor substrate and nozzle plate therefor attached to the first surface of the jet head box in the first recessed portion;

conductive leads attached to the semiconductor substrate, the conductive leads and semiconductor substrate containing contact pads; and an encapsulant for encapsulating the contact pads on the conductive leads and semiconductor substrate.

11. The fluid jetting device of claim 10 further comprising a filter media for filtering fluid to be jetted.

12. The fluid jetting device of claim 11 wherein the filter media is attached in a second recessed portion defining a filter area in the second surface of the jet head box.

13. The fluid jetting device of claim 11 wherein the filter media is attached to the semiconductor substrate between the semiconductor substrate and the first surface of the jet head box.

14. The fluid jetting device of claim 11 wherein the filter media is incorporated in the nozzle plate between the nozzle plate and semiconductor substrate.

15. The fluid jetting device of claim 10 wherein, the encapsulant has a substantially sloped surface extending from the encapsulant dam to the semiconductor substrate.

16. The fluid jetting device of claim 10 wherein the conductive leads are attached to a first end of the semiconductor substrate.

17. The fluid jetting device of claim 10 wherein the conductive leads are attached to opposing first and second ends of the semiconductor substrate.

18. The fluid jetting device of claim 10 wherein the encapsulant comprises a snap cure adhesive.

19. The fluid jetting device of claim 10 wherein the encapsulant is a conductive epoxy encapsulant.

20. The fluid jetting device of claim 10 wherein the body comprises a body portion and at least one encapsulant dam portion separate from the body portion, and wherein the conductive leads comprise a tape automated bonding circuit (TAB).

21. The fluid jetting device of claim 20 wherein the encapsulant dam portion is attachable to the body portion using sockets and posts, an adhesive, or an adhesive and sockets and posts.

* * * * *